US005384951A

United States Patent [19]

Karsten, Jr. et al.

[11] Patent Number: 5,384,951

[45] Date of Patent: Jan. 31, 1995

[54] METHOD OF MAKING ANISOTROPICALLY LOADED HELIX ASSEMBLY FOR A TRAVELING-WAVE TUBE

[75] Inventors: Kenneth S. Karsten, Jr., Bethlehem; Richard C. Wertman, Allentown, both of Pa.

[73] Assignee: ITT Corporation, New York, N.Y.

[21] Appl. No.: 150,224

[22] Filed: Nov. 10, 1993

Related U.S. Application Data

[62] Division of Ser. No. 939,305, Sep. 2, 1992.

[51] Int. Cl.[6] ..... H01P 11/00

[52] U.S. Cl. ..... 29/600; 228/124.1; 315/3.5

[58] Field of Search ..... 29/600, 605; 228/180.1, 228/124.1; 315/3.5

[56] References Cited

U.S. PATENT DOCUMENTS

| | | | |
|---|---|---|---|
| 3,624,678 | 11/1971 | Falce | 29/600 |
| 3,748,729 | 7/1973 | Bottcher et al. | 29/600 |
| 3,808,677 | 5/1974 | Eallonardo | 29/600 |
| 4,178,533 | 12/1979 | Ribout et al. | 29/600 X |
| 4,894,628 | 1/1990 | Dadswell | 29/600 X |
| 5,079,830 | 1/1992 | Kobale et al. | 29/600 |

*Primary Examiner*—Carl J. Arbes

*Attorney, Agent, or Firm*—Arthur L. Plevy; Patrick M. Hogan

[57] ABSTRACT

The present invention is an anisotropically loaded helix assembly for use in a traveling-wave tube, and the corresponding method for making the same. The present invention includes a helix circuit concentrically supported within a conductive cylindrical housing by a plurality of dielectric support members. The present invention effects an improved efficiency and bandwidth in the performance of TWT by the material used to form the dielectric support members, the shape of the dielectric support members and the manner by which the anisotropic load is affixed to the dielectric support members.

11 Claims, 6 Drawing Sheets

METHOD OF MAKING ANISOTROPICALLY LOADED HELIX ASSEMBLY FOR A TRAVELING-WAVE TUBE

This is a division of application Ser. No. 07/939,305, filed Sep. 2, 1992.

FIELD OF THE INVENTION

The present invention relates to an anisotropically loaded helix assembly for use in a traveling-wave tube and the method for making the same, and more particularly to such anisotropically loaded helix assemblies that utilize selectively shaped dielectrics, such as aluminum nitride or $Be^o$ that can be directly coated with a conductor to create the anisotropic load.

BACKGROUND OF THE INVENTION

As will be recognized by a person skilled in the art, the phase velocity within a traveling-wave tube (TWT) varies with frequency. As frequency is reduced, the number of helix turns per wavelength increases. As a result, the coupling of electric and magnetic fields between the turns of the helix change, and there is a cancellation of the magnetic flux between the adjacent turns. Consequently, the inductance of the TWT helix decreases, allowing the wave velocity to increase. Additionally, as the frequency is reduced and the number of helix turns per wavelength increases, the electric field created by the helix extends further from the helix.

In order to slow the wave velocity, and consequently the phase velocity, within a TWT, a metal housing is concentrically placed around the helix. Since low frequency signals create electric fields that extend further from the TWT helix, than do high frequency signals, a metal housing can be used to decrease wave velocity at low frequencies while having very little effect on high frequency operation. The effectiveness of the metal housing on slowing wave velocity at low frequencies is proportional to the distance of the metal housing from the TWT helix. Unfortunately, to bring the metal housing closer to the TWT helix also has the accompanying disadvantage of decreasing circuit interaction impedance, which decreases the gain and efficiency of the TWT. Ideally, if a metal housing could be created that conducted only in its axial direction, the effect of the metal housing on circuit impedance could be avoided because no circumferential currents from the TWT helix would flow into surrounding metal shell.

In practice, an axially conducting shell is approximated by a technique commonly referred to as anisotropic loading. In anisotropic loading, a metal shell is concentrically supported around the TWT helix by a plurality of dielectric supports. Shaped conductive members are then attached to the inside diameter of the surrounding metal housing and are extended down toward the TWT helix, in between the dielectric supports. The conductive members are commonly called loading vanes and the dispersion of the TWT helix is controlled by shape and position of the loading vanes relative to both the central helix and the surrounding metal housing. In addition to the presence of the conductive loading vanes, wave velocity within the TWT helix is also effected by the presence of the dielectric supports that separate the TWT helix from the surrounding metal housing. Wave velocity is inversely proportional to the square root of the dielectric constant of the material from which the supports are produced. Consequently, when dielectric material is added in the region surrounding the TWT helix, the wave velocity within the TWT helix decreases.

Referring to FIGS. 1*a*, 1*b* and 1*c*, three typical prior art anisotropic loading configurations are shown for a TWT. In FIG. 1*a*, a metal housing 10 is concentrically supported around a TWT helix 12 by a plurality of symmetrically disposed dielectric supports 14. On the inner diameter wall of the metal housing, are supported a plurality of conductive loading vanes 16. The dielectric supports 14 and the loading vanes 16 are held in place by being either brazed, adhesively bonded or mechanically fastened to the inner diameter wall of the metal housing. Similarly, the dielectric supports 14 are either brazed, adhesively bonded or mechanically fastened to the TWT helix.

In FIG. 1*b*, a TWT is shown wherein a plurality of shaped metal clips 18 are used as the loading vanes. The clips 18 also act to hold the dielectric members 14 symmetrically in place around the TWT helix 12. In FIG. 1*c* a TWT is shown having large solid loading vanes 20. As with the embodiment of FIG. 1*a*, the solid loading vanes must be either brazed, mechanically fastened or adhesively attached to the metal shell 10.

The embodiments of the prior art do have some substantial disadvantages. In the prior art, the manufacturing of an anisotropic loaded TWT is usually a labor intensive and expensive process. In prior art assembly methods, the insertion of the dielectric supports, and the TWT helix, into the metal shell may be done by heating the metal shell and TWT helix in a vacuum oven. Furthermore, the mass of the loading vanes usually produce an excessive overall shell loading which cause a reduced interaction impedance.

It will be recognized by a person skilled in the art, that such hot insertion manufacturing techniques requires the TWT assembly to cool for hours before it can be tested. Additionally, prior art methods use large conductive elements to form the loading vanes. These conductive elements, either in the form of metal clips or vanes, are expensive to manufacture and require very exacting manufacturing techniques to assemble the TWT helix, metal housing and loading vanes in a concentric orientation. Additionally, the use of separate loading vanes and dielectric supports have made prior art TWT's susceptible to sudden changes in acceleration and other shocks which may dislodge a loading vane element or alter the TWT's concentric construction.

Another disadvantage of many prior art TWTs is the material used to construct the dielectric supports that separates the TWT helix from the metal shell. In prior art TWTs, the dielectric supports are often constructed by beryllia or boron nitride. Both beryllia and boron nitride are expensive materials. Furthermore, the thermal conductivity of both beryllia and boron nitride are limited, creating theoretical limitations on the performance characteristics of a TWT.

In view of the above stated problems in the prior art, it is therefore a primary object of the present invention to provide a anisotropically loaded helix assembly for use in a TWT, and a method for making the same, that produces a TWT that is lower in cost, easier to manufacture, more resistive to shock, has a higher temperature range and operates more efficiently than other common anisotropically loaded TWTs.

BRIEF DESCRIPTION OF THE DRAWINGS

For a better understanding of the present invention, reference is made to the following description of an exemplary embodiment thereof, considered in conjunction with the accompanying drawings, in which.

SUMMARY OF THE INVENTION

Figure 1A:
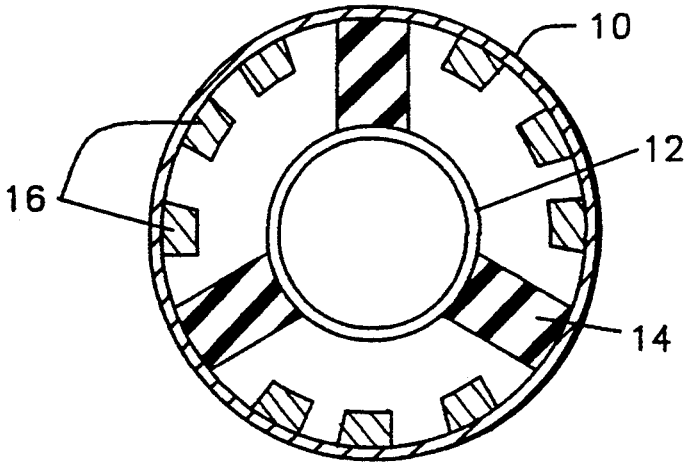
FIG. 1a PRIOR ART
FIG. 1*a* is a cross-sectional view of a first prior art embodiment of an anisotropically loaded traveling-wave tube.
Figure 1B:
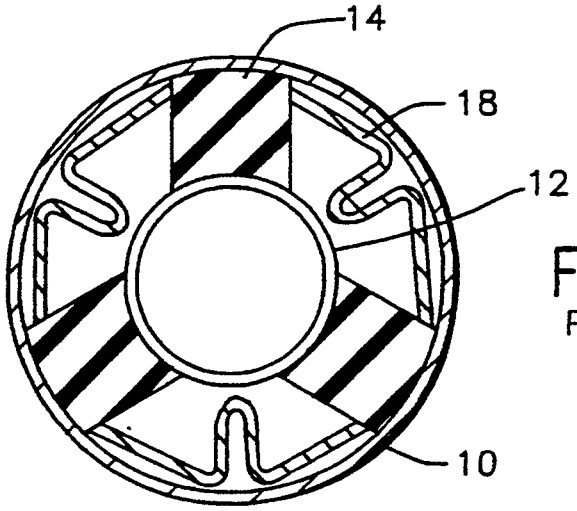
FIG. 1b PRIOR ART
FIG. 1*b* is a cross-sectional view of a second prior art embodiment of an anisotropically loaded traveling-wave tube.
Figure 1C:
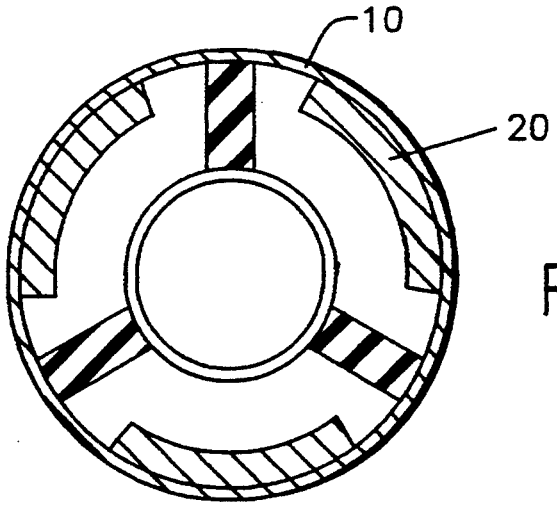
FIG. 1c PRIOR ART
FIG. 1*c* is a cross-sectional view of a third prior art embodiment of an anisotropically loaded traveling-wave tube.

The present invention is an anisotropically loaded helix assembly for use in a traveling-wave tube, and the corresponding method for making the same. The present invention includes a helix or any alternate slow wave structure circuit, concentrically supported within a conductive cylindrical housing by a plurality of dielectric support members. In one preferred embodiment, the anisotropic load, in the form of a strip of conductive material, is deposited directly onto the dielectric support members using a known technique such as silk screening, photolythographic controlled vapor deposition or the like. By depositing a strip of conductive material directly onto the dielectric support members, the labor and cost of manufacturing and assembling separated anisotropic loading vanes is removed, thereby allowing the present invention to be more easily and less expensively manufactured. Furthermore, part tolerances can be more readily controlled, thereby reducing variations from one device to another. By reducing variation between manufactured components, the yield of the TWT can be increased. Additionally, by utilizing conductive material selectively deposited directly onto the dielectric support members, the performance of a TWT can be improved. In an anisotropically loaded TWT there exist regions where there is little or no inductance interaction in between the helix circuit and the surrounding anisotropic load. Such positions occur at the beginning and end of the helix circuit as well as in the center of loss patterns. In the present invention, the strip of conductive material, deposited onto each dielectric support member, is only electrically coupled to the surrounding cylindrical housing in areas where there is little or no impedance interaction. By constructing the anisotropic loads in such a manner, the exchange of circumferential currents from the helix circuit to the cylindrical housing is reduced, thereby improving the overall axial vane loading, bandwidth range and efficiency of the TWT.

The use of anisotropic loads directly deposited onto the dielectric support members has the added advantage of allowing the impedance of the anisotropic load to be readily varied, per unit length, so as to provide impedance matching to the helix circuit. The impedance of the anisotropic load may be effected by selectively shaping the conductive strips so as to follow the needed impedance value profile.

The present invention can effect further advantages over the prior art through the material and shape into which the dielectric support members are fabricated. In the present invention, the dielectric support members are preferably formed from aluminum nitride. The use of aluminum nitride provides an advantage over prior art boron nitride and beryllium dielectrics, in that aluminum nitride is less expensive, has a higher thermal conductivity and effects a higher gain per inch within the TWT.

It is well known in the art that wave velocity within an un-loaded TWT helix circuit increases as the frequency of the inputted signal decreases. The variations in wave velocity causes phase variations which reduce the overall gain of the TWT. The use of dielectrics adjacent to the helix circuit decreases the wave velocity within the TWT helix circuit. As such, the use of a specifically shaped dielectric support member can compensate for the increase in wave velocity caused by a low frequency signal. Low frequency signals produce loose electromagnetic field lines, thereby producing a limited flux within the helix circuit and allowing the wave velocity to increase. As the signal frequency increases, electromagnetic field lines become more concentrated near the helix circuit and the wave velocity slows. By creating a dielectric support member that is wide near the cylindrical housing and narrow near the helix circuit, a device is formed that effects the electromagnetic field of low frequency signals disproportionately to high frequency signals. Since the dielectric material affects electromagnetic fields so as to slow wave velocity, the dielectric support member can be appropriately shaped to counteract the increase in wave velocity produced by a low frequency signal.

The specification also provides a corresponding method for assembling an anisotropically loaded helix assembly. The present method includes elastically deforming the cylindrical housing so that the helix circuit and dielectric support rods can be placed therein. Once positioned within the cylindrical housing, the cylindrical housing is returned to its nominal shape, completing the assembly in a time and cost efficient manner. The present invention metalized dielectric support rods loading vanes can be used in any other variety of TWT assembly methods. Regardless to the method of assembly, assembly is simplified by the user of less component parts.

DETAILED DESCRIPTION OF THE DRAWINGS

Figure 2:
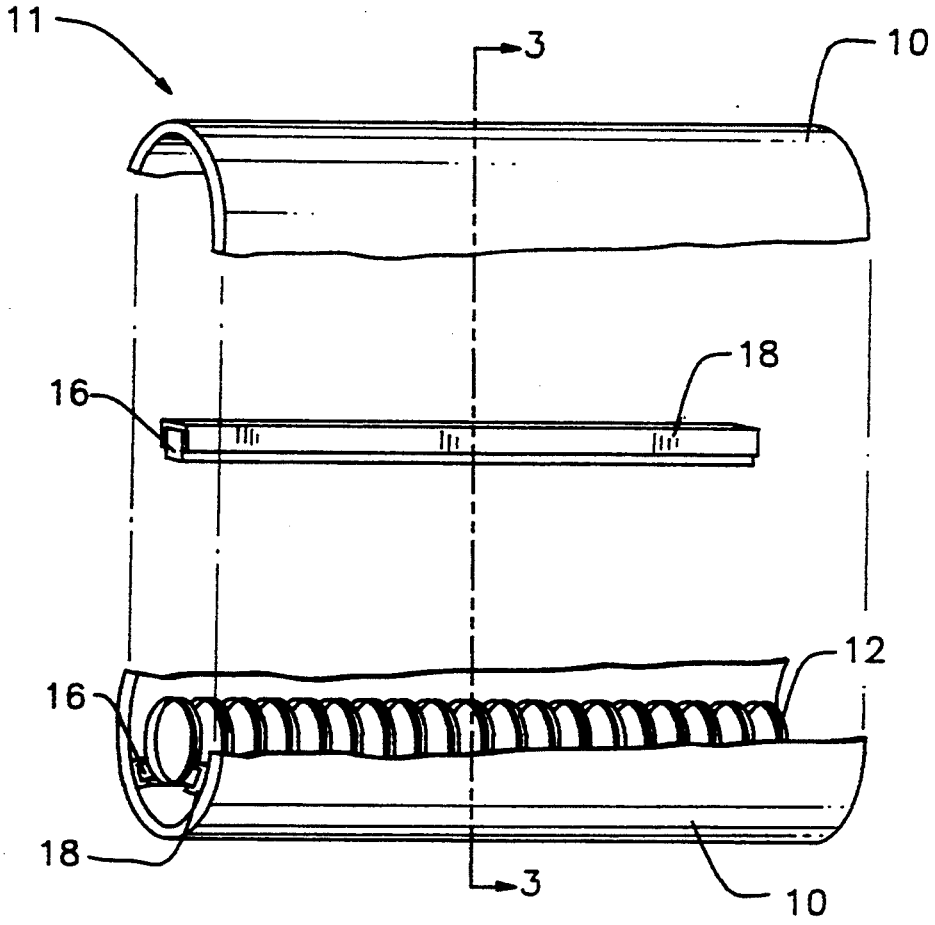
FIG. 2 is a perspective exploded view of one preferred embodiment of the present invention anisotropically loaded traveling-wave tube helix and shell assembly.
Figure 3:
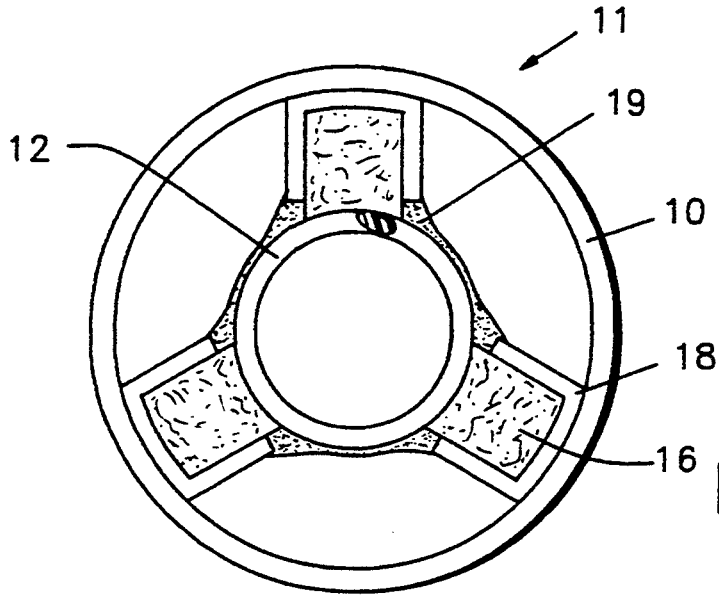
FIG. 3 is a cross-sectional view of the traveling-wave tube helix and shell assembly as depicted in FIG. 2, viewed along section line 3—3.

Referring to FIG. 2, in conjunction with FIG. 3, there is shown a traveling-wave tube helix and shell assembly 11, used in the construction of an anisotropically loaded traveling-wave tube (TWT). The helix and shell assembly 11 comprises a conductive helix 12 concentrically positioned within a metal cylinder 10. The helix 12 is supported within the cylinder 14 by a plurality of dielectric support members 16 formed from aluminum nitride (herein AlN) or any other dielectric material capable of being metalized. The AlN support members 16 are symmetrically disposed around the helix 12, thereby being one hundred and twenty degrees apart for the three AlN support members 16 in the shown embodiment. Each of the AlN support members 16 is subjected to a metalizing procedure wherein a selectively shaped layer of conductive material 18 is deposited onto the AlN support members 16. The layer of conductive material 18 can be deposited onto the AlN support members 16 using known metalization techniques, but is preferably applied to the AlN support members 16 using known silk screening application procedures. In the shown embodiment the conductive material 18 is deposited along three adjacent sides of the AlN support member 16 so as to form a substantially U-shaped anisotropic load across the length of each AlN support member 16. By depositing the conductive material 18 directly onto the AlN support members 16, anisotropic loads are created that do not need to be separately assembled, thereby reducing the time and labor required during the assembly procedure. Additionally, by depositing the anisotropic loads directly onto the AlN support members 16, the overall assembly becomes more resistive to physical shock, which would dislodge separately formed prior art loading vanes. To assemble the present invention TWT helix and shell assembly 11, the AlN support members 16 with the helix 12 must be positioned within the metal cylinder 10. The AlN support members 16, with its integrally formed conductive loading vanes are affixed to the helix 12 using a non-conductive, high-temperature adhesive 19 such as EASTMAN cement type 4655. The attachment of the AlN support members 16 to the metal cylinder 10 is done without the use of adhesives or mechanical fasteners, as will later be described when detailing the preferred manufacturing method.

Typically, prior art anisotropically loaded traveling-wave tubes utilize boron nitride (herein BN) or beryllia material in forming the dielectric support members that separate the helix 12 from the metal cylinder 10. However, the use of AlN support member 16 in place of BN or beryllia support members has advantages that improve the state of the art for TWTs. The presence of dielectric support members, within an anisotropically loaded TWT, cause the wave velocity within the helix 12 to decrease. Wave velocity is inversely proportional to the square root of the dielectric constant of the support members. The use of AlN support members 16 in place of BN or beryllia support members creates an increase in efficiency in the performance of the TWT in the form of a higher gains per inch due to a lower loss tangent. Additionally, AlN support members 16 have a higher thermal conductivity than do similarly formed BN support members, and AlN support members 16 have a thermal conductivity that is higher than beryllia at temperatures greater than 100° C. Consequently, AlN support members 16 dissipate heat more rapidly than does the prior art, providing the present invention a thermal advantage in its operating temperature range. Furthermore, the cost of AlN support members 16 is far less than the cost of BN or beryllia support members, providing the present invention with a cost advantage over the prior art.

Figure 5:
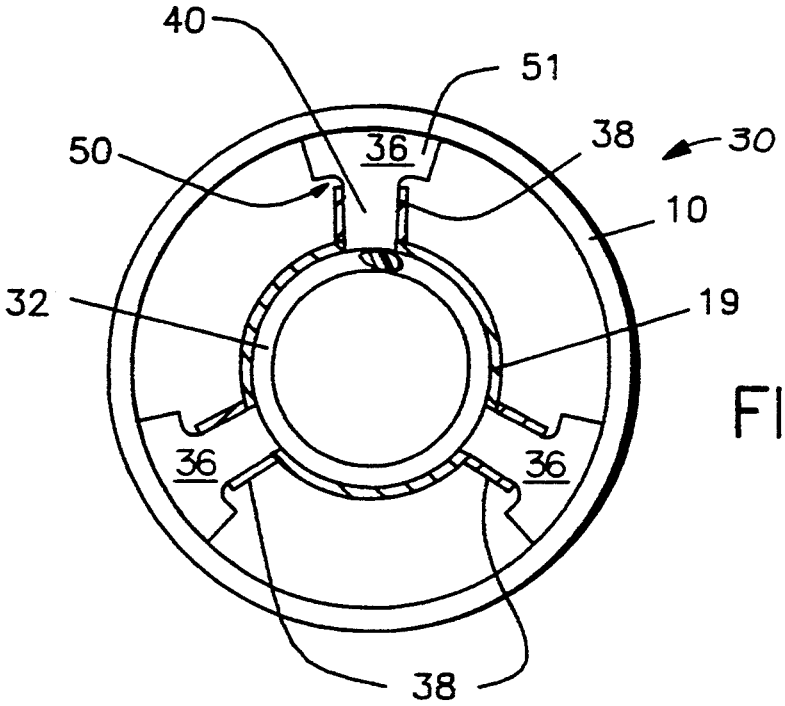
FIG. 5 is a cross-sectional view of the traveling-wave tube helix and shell assembly as depicted in FIG. 4, viewed along section line 4—4.
Figure 4:
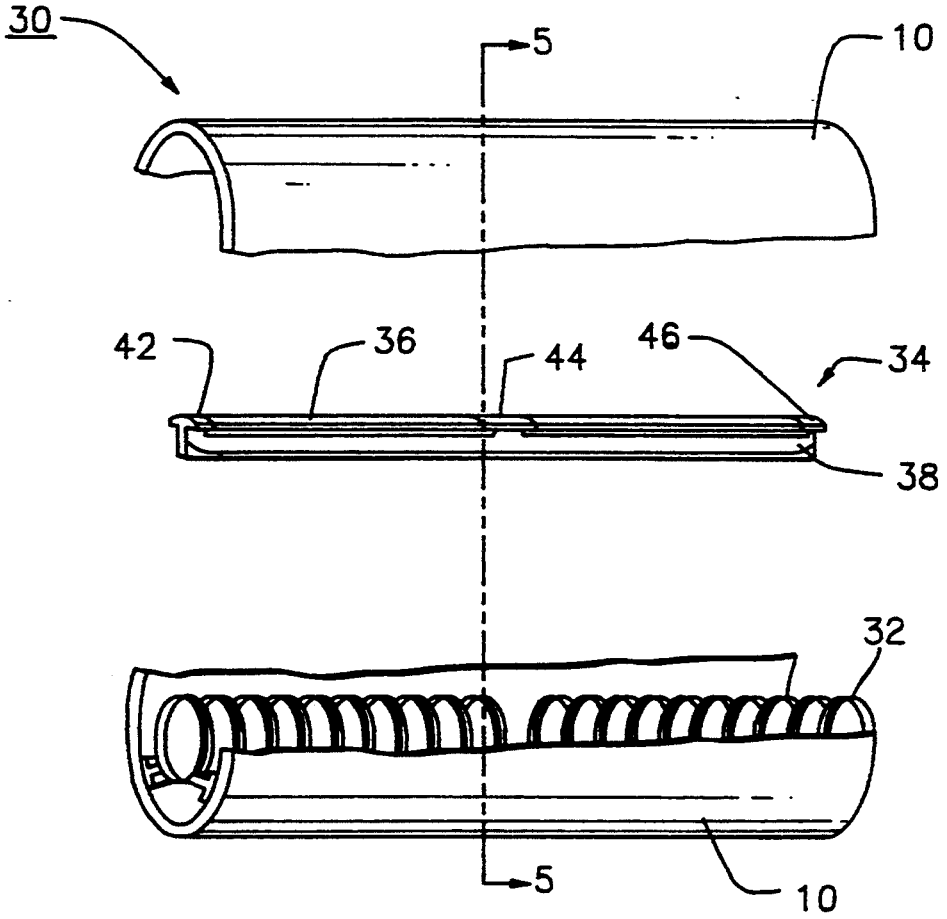
FIG. 4 is a perspective exploded view of a second preferred embodiment of the present invention anisotropically loaded traveling-wave tube helix and shell assembly.

Referring to FIG. 4, in conjunction with FIG. 5, an alternative embodiment of the present invention TWT helix and shell assembly 30 is shown. The shown embodiment of the TWT helix and shell assembly 30 includes a conductive helix assembly 32 concentrically positioned within a metal cylinder 10. Supporting the helix assembly 32 within the metal cylinder 10 are a plurality of support member assemblies 34. The support member assemblies 34 are symmetrically disposed around the helix assembly 32, therefore being one hundred and twenty degrees apart for the three support member assemblies 34 in the shown embodiment.

The helix assembly 32 is comprised of two helices which are oppositely wound and connected in the center of a loss pattern or one singular split helix. Such two-piece helical windings are known and widely used in the art. Each of the support member assemblies 34 are comprised of a shaped dielectric base 36 on which are formed strips of conductive material 38. The shaped dielectric base 36 is preferably created of aluminum nitride for the reason stated in the description of FIGS. 2 and 3, however, it should be understood that the dielectric base 36 can be formed of any dielectric material including boron nitride or beryllia. In the present invention the separate conductive loading vanes of the prior art are replaced by a strip of conductive material, herein called loading strips 38 that can be deposited on either side of the dielectric base 36. The loading strips 38 may be formed from copper, gold or any other highly conductive material. The loading strips 38 are deposited along the length of the dielectric base 36 so that the main body of the loading strip 38 is supported between the helix assembly 32 and the metal cylinder 10. The loading strip 38 may be deposited on the dielectric base 36 utilizing any known method such as sputter deposition or the like, but the loading strips 38 are preferably created using known silk screening techniques.

The various loading strips 38 can be formed to mimic prior art loading vanes by forming loading strips 38 so they are substantially U-shaped and contact the metal cylinder 10 across the entire length of the dielectric base. However, as can be seen from FIGS. 4 and 5, the present invention is preferably constructed so that the loading strips 38 only contact the surrounding metal cylinder at three discrete contact points 42, 44, 46. The first and last contact point 42, 46 correspond in position to the forward and distant ends of the helix assembly 32. At these points the interaction between the loading strips 38 and the electromagnetic field of the helix assembly 32 are at a minimum. The center contact point 44 corresponds in position to the split between the two helices, which also corresponds to the center point within a loss pattern. In a center of a loss pattern there is also a reduction in interaction between the anisotropic load and the electromagnetic field produced by the helix assembly 32. By only coupling the loading strips 38 to the metal cylinder at points of low electromagnetic interaction, the corresponding circumferential currents, created by the coupling, also occur at points of low electromagnetic interaction. Consequently, circumferential currents are reduced and the anisotropic loading effects of the TWT helix and shell assembly 30 are improved, resulting in a TWT with an improved operational bandwidth.

The coupling of the loading strips 38 to the metal cylinder can be accomplished by increasing the width of the loading strips 38 so that the deposited material covers the section of the dielectric base 36 that contacts the metal cylinder 10. The overlap of the deposited material on the surface of the dielectric base 36 becomes the discrete contact points 42, 44, 46. Alternatively, a loss conductive carbon pattern can be deposited onto the dielectric base 36 at a point corresponding to the discrete contact point 44 for a single loss pattern TWT. The conductive carbon deposit then acts to couple the loading strips 38 to the metal cylinder. The low resistance connection created by the carbon deposit only allows azimuthal shell currents to be generated at the loss sections, wherein the negative effects of the shell currents are minimal.

By using loading strips 38, deposited onto the dielectric base 36, in place and stead of individually formed conductive loading vanes, the overall outer shell loading is reduced. Consequently, the reduced interaction impedance created by the metal cylinder 14 is reduced and the TWT can operate more efficiently. Furthermore, the use of loading strips 38, deposited onto the dielectric base 36, represents a reduction in parts, labor and expense as compared to prior art individually formed loading vanes.

In addition to the improved efficiency obtained by selectively coupling the loading strips 38 to the metal cylinder 14, the operational efficiency of the TWT can be further improved by selectively shaping both the dielectric base 36 and the loading strips 38 deposited onto the dielectric base 36. Referring to FIGS. 4 and 5, it can be seen that the dielectric base 36 has a substantially T-shaped profile. As was previously explained, as the signal frequency within the helix assembly 32 decreases, the electromagnetic field lines produced by the helix assembly propagate away from the windings of the helix, there is a reduction in flux, and the wave velocity of the signal increases. Adversely, the presence of dielectric material within the electromagnetic field of the helix assembly 32 causes the wave velocity of a signal to decrease. As such, the effects of a low frequency signal and the presence of a dielectric material cause opposite effects of the wave velocity within the helix assembly 32. Consequently, the shape of the dielectric base 36 can be specifically formed so as to compensate for the decrease in wave velocity caused by a low frequency signal, thereby increasing the operating parameters in which the TWT can efficiently operate. As a signal frequency decreases, the electromagnetic field lines created by the helix assembly 32 move further away from the helix assembly 32. As such, in order to effect the wave velocity caused by a low frequency signal, without substantially affecting the wave velocity of a high frequency signal, the presence of the dielectric material is maximized in areas that are primarily affected by the electromagnetic field of a low frequency signal. Similarly, the presence of the dielectric material is minimized in areas primarily affected by the electromagnetic field of a high frequency signal. It is for this reason that the shown dielectric base 36 has a thin stem region 40 that contacts the helix assembly 32. The length of the stem region 40 corresponds to the mean range of the electromagnetic field created by a high frequency signal. The head region 51 of the dielectric base 36 is much wider than the stem region 40 and corresponds to the mean range of the electromagnetic field created by a low frequency signal. As such, the dielectric base 36 can compensate for some of the phase velocity variations caused a low frequency signal. In view of the above disclosure, it should be apparent to a person skilled in the art that the shape of the dielectric base 36 is governed by the particular wave velocity variations for a given TWT application. For example, if for a given TWT the position of the electromagnetic field lines were in a linear proportional relationship to the signal frequency, the dielectric bases 36 may be formed with linear sloped walls so as to compensate for the effects of the low frequency signal on wave velocity (see FIG. 7). Similarly, if the position of the electromagnetic field lines were in an expediential relationship to the signal frequency, the dielectric bases 36 may also include an expediential change in thickness so as to compensate for the changes wave velocity. Such an expediential change in thickness is shown in FIG. 5 as contour 50 connecting the head region 51 of the dielectric base 36 to the stem region 40.

Figure 6:
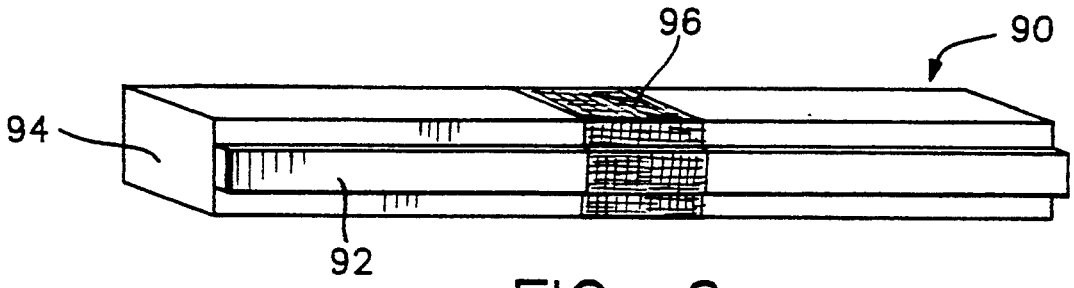
FIG. 6 is a perspective view for an alternate construction for a dielectric support member, formed in accordance with the present invention.

Referring to FIG. 6, a simple form of a support member assembly 90 is shown. In this embodiment, loading strips 92 are formed on either side of a dielectric base 94. The loading strips 92 are then connected at a single point by a conductive carbon pattern 96. By connecting the loading strips 96 at a single point, a single loss pattern can be created for a TWT.

Figure 7:
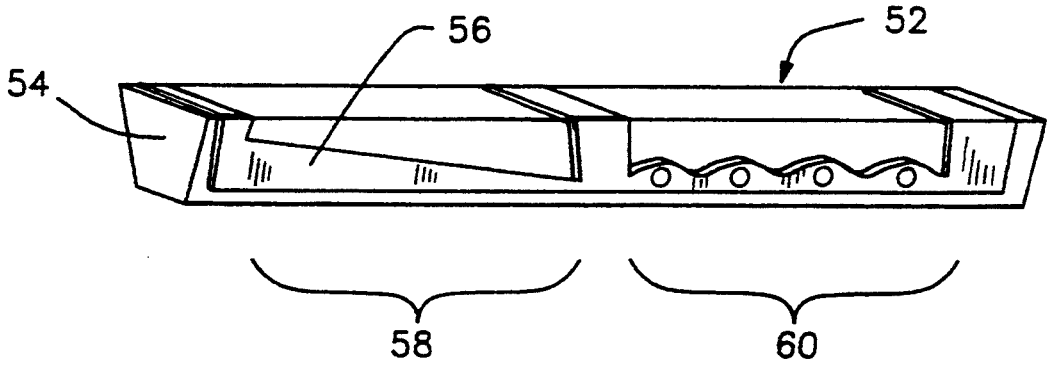
FIG. 7 is a perspective view of a second alerate construction for a dielectric support member, formed in accordance with the present invention.

Referring to FIG. 7, yet another alternate embodiment is shown for a support member assembly 52. The support member 52 includes a dielectric base 54 having a substantially V-shaped profile. Formed on the side of the dielectric base 54 is a conductive loading strip 56, deposited in the manner previously described. However, in the embodiment of FIG. 7, the loading strip 56 is not uniformly formed. The loading strip 56 is formed to vary in impedance, per unit length, as it transgresses the length of the dielectric base 54. The variations of impedance as a function of length can be preformed in many known manners and may include a taper within the loading strip 56 as shown in section 58 or a formed shape created as part of the loading strip 56 as shown in section 60. The impedance of the loading strip 56 is formed to improve impedance match between the helix assembly and the loading strips 56 as well as to improve the interaction at the band edges of the helix circuit, to increase bandwidth or band centers.

Figure 8A:
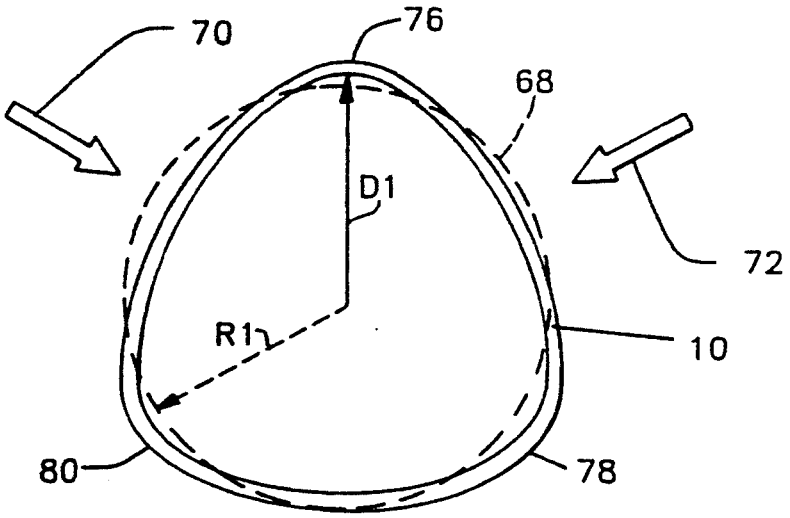
FIG. 8*a* is an end view of a preferred embodiment of a traveling-wave tube shell, elastically deformed from circular by three symmetrically disposed forces.
Figure 8B:
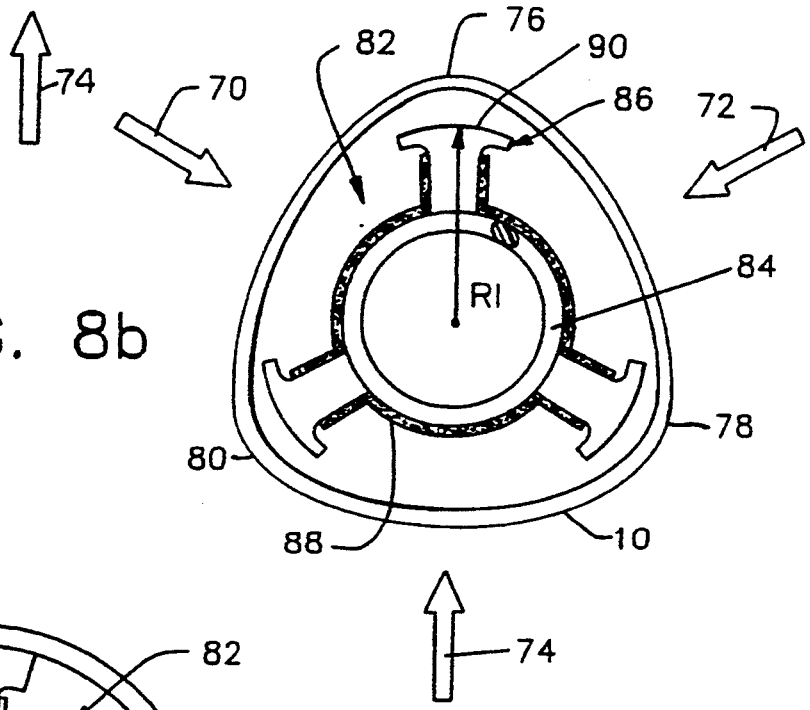
FIG. 8*b* shows a traveling-wave tube helix assembly positioned within the traveling-wave tube shell, shown in FIG. 8*a*.
Figure 8C:
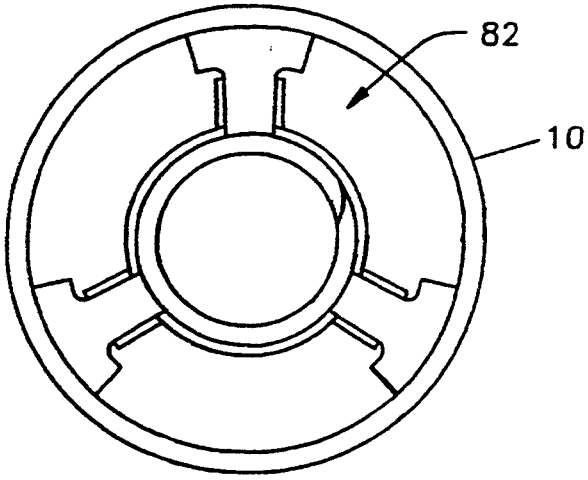
FIG. 8*c* shows the final position of the traveling-wave tube helix of FIG. 8*b* within the shell once the deforming forces acting on the shell have been removed.

Regardless of the construction of the support member assembly, the helix assembly is supported by the support member assemblies within a metal cylinder 10. In the past, the assembly of the helix assembly and support member assemblies within the metal cylinder 10 was a time consuming and labor intensive operation. Referring to FIGS. 8*a* through 8*c*, a new assembly method is shown that reduces the amount of labor, time and expense involved within the assembly procedure and produces a more reliable TWT helix and shell assembly. In FIG. 8*a* there is shown a metal cylinder 10, being elastically deformed by the influence of three symmetrically disposed forces (shown by arrows 70, 72, 74). When at rest the metal cylinder 10 would have a nominal radius R1 and would have a round profile shown by hidden lines 68. The forces applied to the metal cylinder 10 elastically deform it from its nominal shape. Since there are three forces 70, 72, 74 acting on the metal cylinder 10 at symmetrically opposed positions, the metal cylinder 10 is deformed into a triangular shape having three round apexes 76, 78, 80 occurring between the various applied forces. Each apex 76, 78, 80 is now a distance D1 from the center of the metal cylinder, where D1 is larger than radius R1.

In FIG. 8*b* there is shown a loaded helix assembly 82 positioned within the elastically deformed metal cylinder 10. The helix assembly 82 includes the central helix 84 around which are symmetrically positioned three support member assemblies 86. The support member assemblies 86 are attached to the central helix 84 with adhesive 88. The surface 90 of each support member assembly 82, opposite the helix 84, is curved to match the inner diameter of the metal cylinder 10 in its nominal shape. The distance of each surface 90 is at the radius R1 from the center of the helix, which is slightly larger than the nominal radius of the metal cylinder 10. Since the inner diameter of the metal cylinder 10 and the loaded helix assembly 82 are close in size, an interference fit occurs when the loaded helix assembly 82 is advanced into the metal cylinder 10. The interference fit is removed by the deformation of the metal cylinder 10. When the metal cylinder 10 is deformed, three apexes 76, 78, 80 occur in its configuration. The three support member assemblies 86 are aligned with the three apexes 76, 78, 80, and the loaded helix assembly 82 is inserted into the metal cylinder 10. Once the loaded helix assembly 82 is loaded into the metal cylinder 10 the deforming force is removed and the metal cylinder 10 returns to its nominal shape. By returning to its nominal shape, the metal cylinder 10 traps the loaded helix assembly 82 into place (see FIG. 8*c*). The loading helix assembly 82 is prevented from being removed from the metal cylinder 10 by the interferences fit between the metal cylinder 10 and the compression of the metal cylinder 10 around the loaded helix assembly 82 caused by the interference fit.

By elastically deforming the metal cylinder 10, inserting the loaded helix assembly 82 into the metal cylinder and letting the metal cylinder 10 return to its nominal shape, a multitude of advantages are had over prior art assembly methods. The described deformation method of construction automatically concentrically aligns the loaded helix assembly 82 with the metal cylinder, thereby eliminating labor, time and costs. The described deformation method of construction also allows the completed helix and shell assembly to be immediately advanced to the next level of assembly without waiting for the components to cool or have the loaded helix assembly 82 otherwise cure to the metal cylinder 10. Furthermore, since the assembly of the loaded helix assembly 82 to the metal cylinder 10 is accomplished without adhesives or mechanical fasteners, an improved resistance to mechanical shock is realized over the existing prior art.

It should be understood that the embodiments of the present invention specifically described in conjunction with the figures were merely exemplary and that a person skilled in the art may make variations and modifications to the shown embodiments without departing from the spirit and scope of the invention. All such variations and modifications are intended to be included within the scope of the invention as defined in the appended claims.

What is claimed is:

1. A method of manufacturing an anisotropically loaded helix assembly for use within a traveling-wave tube, comprising the steps of:

selectively depositing conductive material onto a plurality of dielectric support members in predetermined configurations, creating a desired anisotropic load;

attaching said dielectric support members to a helix circuit forming a subassembly of a predetermined configuration; and inserting said subassembly into a conductive cylindrical housing such that said conductive material is selectively coupled to said cylindrical housing.

2. The method of claim 1, wherein said step of depositing includes metalizing said dielectric support members by applying said conductive material to said dielectric support member with a silk screen process, whereby said conductive material is selectively deposited on said dielectric support members in predetermined configurations.

3. The method of claim 1, wherein said predetermined configuration of said subassembly has a dimensional interference with said cylindrical housing, preventing the passage of said subassembly into said housing and wherein said step of inserting includes elastically deforming said cylindrical housing, by selectively applying a deforming force to said cylindrical housing, whereby said cylindrical housing expands to remove said interference; placing said sub-assembly within said elastically deformed cylindrical housing; and removing said deforming force such that said cylindrical housing returns to a nominal position, creating a compression fit between said sub-assembly and said housing, said compression fit operative to trap said helix assembly in place during operation of said traveling-wave tube.

4. The method of claim 3, wherein said step of attaching said dielectric support members to said helix circuit includes adhesively attaching three dielectric support members to said helix circuit in a symmetrically disposed manner to form said sub-assembly with a substantially triangular profile, wherein each dielectric support comprises an apex within said triangular profile.

5. The method of claim 1, further including the step of forming said dielectric support members into shapes such that each said dielectric support member interacts with electromagnetic field lines, produced by said helix circuit in such a manner so as to promote a substantially constant wave velocity within said helix circuit across a given range of frequencies.

6. The method of claim 1, wherein said plurality of dielectric support members are formed from aluminum nitride.

7. A method of manufacturing an anisotropically loaded helix assembly for use within a traveling-wave tube, comprising the steps of:

applying conductive material onto a plurality of dielectric support members with a silk screen process, wherein said conductive material is selectively deposited on said dielectric support members in predetermined configurations, attaching said dielectric support members to a helix circuit forming a subassembly of a predetermined configuration; and inserting said subassembly into a conductive cylindrical housing such that said conductive material is selectively coupled to said cylindrical housing.

8. The method of claim 7, wherein said step of applying is sputtering.

9. The method of claim 7, wherein said step of applying is copper bonding.

10. A method of manufacturing an anisotropically loaded helix assembly for use within a traveling-wave tube, comprising the steps of:

depositing conductive material onto a plurality of dielectric support members creating a desired anisotropic load;

attaching said dielectric support members to a helix circuit, said attaching including adhesively attaching three dielectric support members to said helix circuit in a symmetrically disposed manner to form a subassembly of a predetermined configuration with a substantially triangular profile, wherein each dielectric support comprises an apex within said triangular profile, said predetermined configuration of said subassembly having a dimensional interference with a cylindrical housing preventing the passage of said subassembly into said housing;

elastically deforming said cylindrical housing, by selectively applying a deforming force to said cylindrical housing, whereby said cylindrical housing expands to remove said interference;

placing said sub-assembly within said elastically deformed cylindrical housing; and removing said deforming force such that said cylindrical housing returns to a nominal position, compressing said sub-assembly therein.

11. The method of claim 10, wherein said step of elastically deforming said cylindrical housing includes applying said deforming force to three positions around said cylindrical housing, such that said cylindrical housing expands in between said three positions, allowing for the passage of said sub-assembly therein.

* * * * *